US008821125B2

(12) United States Patent
Hart et al.

(10) Patent No.: US 8,821,125 B2
(45) Date of Patent: Sep. 2, 2014

(54) TURBINE BLADE HAVING IMPROVED FLUTTER CAPABILITY AND INCREASED TURBINE STAGE OUTPUT

(75) Inventors: Adam Lee Hart, Stuart, FL (US); Adam John Fredmonski, Palm City, FL (US); Douglas James Dietrich, West Palm Beach, FL (US); Samer Abdel-Wahab, Jupiter, FL (US); Stephen Wayne Fiebiger, Jupiter, FL (US); Kuo-Ting Hsia, Palm City, FL (US); W. David Day, Jupiter, FL (US); Richard Ramirez, Palm Springs, FL (US)

(73) Assignee: Alstom Technology Ltd., Baden (CH)

( * ) Notice: Subject to any disclaimer, the term of this patent is extended or adjusted under 35 U.S.C. 154(b) by 403 days.

(21) Appl. No.: 13/366,532

(22) Filed: Feb. 6, 2012
(Under 37 CFR 1.47)

(65) Prior Publication Data

US 2013/0202445 A1 Aug. 8, 2013

(51) Int. Cl.
*F01D 5/14* (2006.01)
*F01D 5/16* (2006.01)

(52) U.S. Cl.
USPC ..... 416/193 A; 416/223 A; 416/243; 416/241 R; 416/500; 416/DIG. 2

(58) Field of Classification Search
USPC ..... 415/119, 191–192, 208.1, 208.2, 209.4, 415/210.1; 416/190–192, 193 A, 223 R, 416/223 A, 241 R, 243, 500, DIG. 2, DIG. 5
See application file for complete search history.

(56) References Cited

U.S. PATENT DOCUMENTS

| | | | | |
|---|---|---|---|---|
| 6,474,948 | B1 * | 11/2002 | Pirolla et al. | 416/243 |
| 6,769,878 | B1 | 8/2004 | Parker et al. | |
| 2005/0019160 | A1 | 1/2005 | Hyde et al. | |
| 2005/0025618 | A1 * | 2/2005 | Arness et al. | 415/191 |
| 2005/0111978 | A1 | 5/2005 | Strohl et al. | |
| 2009/0097980 | A1 | 4/2009 | Hayasaka et al. | |
| 2009/0290987 | A1 * | 11/2009 | Parker et al. | 416/241 R |
| 2010/0061862 | A1 * | 3/2010 | Bonini et al. | 416/223 R |
| 2010/0172752 | A1 * | 7/2010 | McGovern et al. | 415/208.1 |
| 2012/0051928 | A1 * | 3/2012 | Lamaster et al. | 416/223 A |
| 2012/0219410 | A1 * | 8/2012 | Kathika et al. | 415/208.1 |

FOREIGN PATENT DOCUMENTS

EP 1411210 A1 4/2004

OTHER PUBLICATIONS

PCT Search Report, dated Nov. 21, 2013 re PCT/US2013/024910, 12 pages.

* cited by examiner

*Primary Examiner* — Christopher Verdier
(74) *Attorney, Agent, or Firm* — Shook, Hardy & Bacon L.L.P.

(57) ABSTRACT

A turbine blade, airfoil configuration, and rotor stage are disclosed in which through the airfoil profile disclosed in Table 1, a modification in airfoil flutter and swirl are achieved. Through the airfoil configuration, the swirl and improved platform sealing configuration, result in the turbine blades having the airfoil profile with an increased performance output from the turbine.

18 Claims, 7 Drawing Sheets

PRESENT INVENTION

TURBINE BLADE HAVING IMPROVED FLUTTER CAPABILITY AND INCREASED TURBINE STAGE OUTPUT

CROSS-REFERENCE TO RELATED APPLICATIONS

Not applicable.

TECHNICAL FIELD

The present invention generally relates to gas turbine engines. More specifically, a turbine blade is disclosed having an airfoil profile that reduces aerodynamic flutter while increasing the overall power output from the stage of the turbine.

BACKGROUND OF THE INVENTION

A typical gas turbine combustor comprises a compressor, at least one combustor, and a turbine, with the compressor and turbine coupled together through an axial shaft. In operation, air passes through the compressor, where the pressure of the air increases and then passes to a combustion section, where fuel is mixed with the compressed air in one or more combustion chambers. The hot combustion gases then pass into the turbine and drive the turbine. As the turbine rotates, the compressor turns, since they are coupled together along a common shaft. The turning of the shaft also drives the generator for electrical applications. The engine must operate within the confines of the environmental regulations for the area in which the engine is located. As a result, more advanced combustion systems have been developed to more efficiently mix fuel and air so as to provide more complete combustion, which results in lower emissions.

As the demand for more powerful and efficient turbine engines continues to increase, it is necessary to improve the efficiency at each stage of the turbine, so as to get the most work possible out of the turbine. To achieve this efficiency improvement, it is necessary to remove any design defects that limit the turbine from achieving its maximum performance. Turbine blades have been known to be limited in power output by a variety of conditions including, but not limited to creep, flutter, and erosion.

Flutter is a dangerous condition caused by the interaction of an airfoil's structural modes of vibration with the aerodynamic pressure distribution on the blade. As the airfoil portion of the turbine blade vibrates, its pressure magnitudes and distributions fluctuate due to the changing flow path geometry. This can result in energy being either added to the flow (a condition know as positive aero-damping) or energy being extracted from the flow (negative aero-damping). If the energy being extracted from the flow is greater than can be dissipated through mechanical damping, the amplitude of the displacements will increase. The cycle repeats itself and is compounded until either the energy input and energy dissipated balance each other, or failure occurs. In order to avoid excessive flutter which can cause component failure, limitations may be placed upon the operating condition of the turbine. Furthermore, excessive flutter outside of acceptable limits can cause the turbine blade to fail over time.

SUMMARY

Embodiments of the present invention are directed towards a system and method for, among other things, a turbine blade having an increased power output which avoids operational limitations found in prior art turbine blade designs.

In one embodiment of the present invention, a turbine blade is disclosed having an attachment, a neck, a platform extending radially outward from the neck, an airfoil extending radially outward from said platform, and a shroud extending radially outward from the airfoil, where the airfoil has an uncoated profile substantially in accordance with Cartesian coordinate values of X, Y, and Z as set forth in Table 1, carried to three decimal places, wherein Z is a distance measured radially from the platform.

In an alternate embodiment of the present invention, an airfoil for a turbine blade having an uncoated profile substantially in accordance with Cartesian coordinate values of X, Y, and Z as set forth in Table 1, carried to three decimal places, wherein Z is a distance measured radially from a platform.

In yet another embodiment of the present invention, a turbine rotor stage is disclosed having a plurality of turbine blades are secured to a rotor disk, the turbine blades each having an airfoil having an uncoated profile substantially in accordance with Cartesian Coordinates values of X, Y, and Z as set forth in Table 1, wherein the profiles generate a reduced swirl exiting from the rotor stage.

Additional advantages and features of the present invention will be set forth in part in a description which follows, and in part will become apparent to those skilled in the art upon examination of the following, or may be learned from practice of the invention.

BRIEF DESCRIPTION OF THE SEVERAL VIEWS OF THE DRAWINGS

The present invention is described in detail below with reference to the attached drawing figures, wherein.

DETAILED DESCRIPTION

The subject matter of the present invention is described with specificity herein to meet statutory requirements. However, the description itself is not intended to limit the scope of this patent. Rather, the inventors have contemplated that the claimed subject matter might also be embodied in other ways, to include different components, combinations of components, steps, or combinations of steps similar to the ones described in this document, in conjunction with other present or future technologies.

Figure 2:
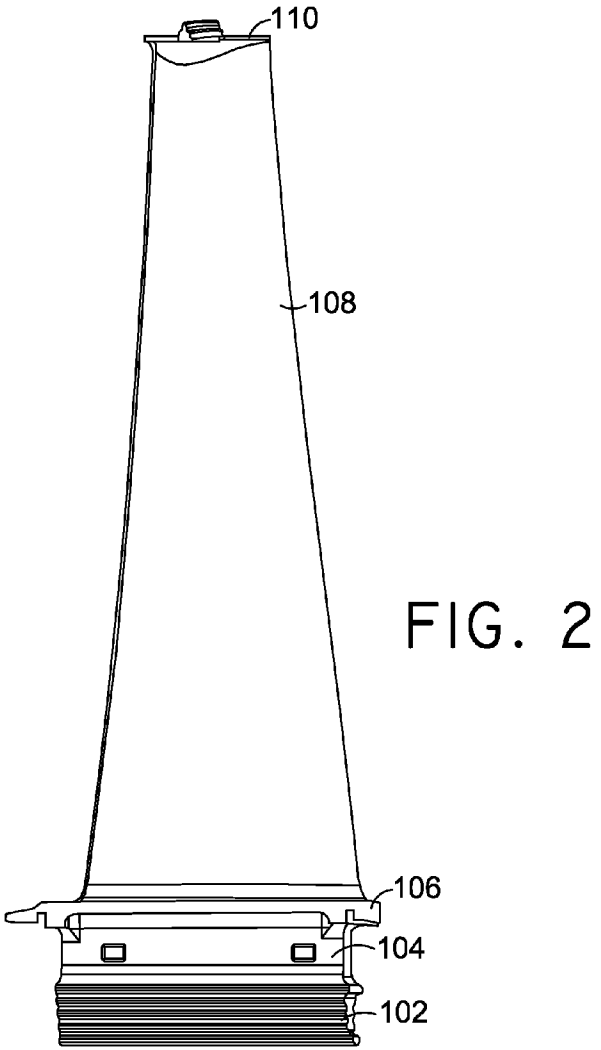
FIG. 2 depicts an elevation view of an embodiment of the present invention.
Figure 1:
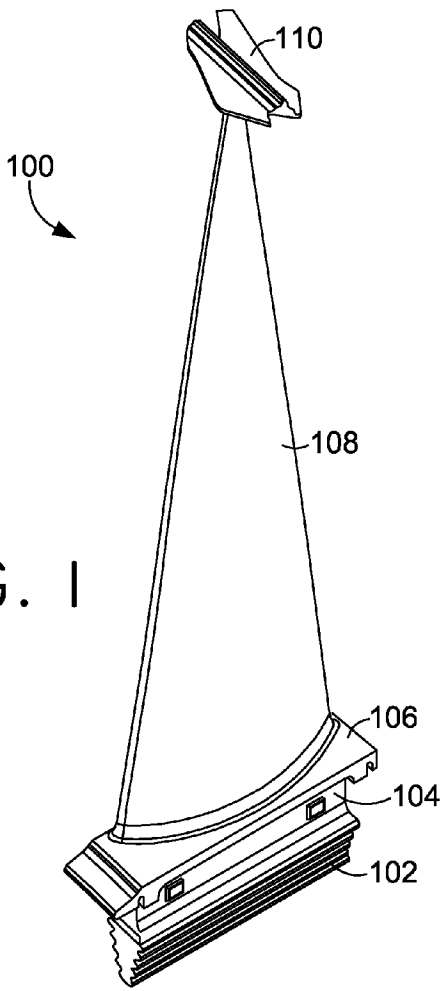
FIG. 1 depicts a perspective view of an embodiment of the present invention.
Figure 3:
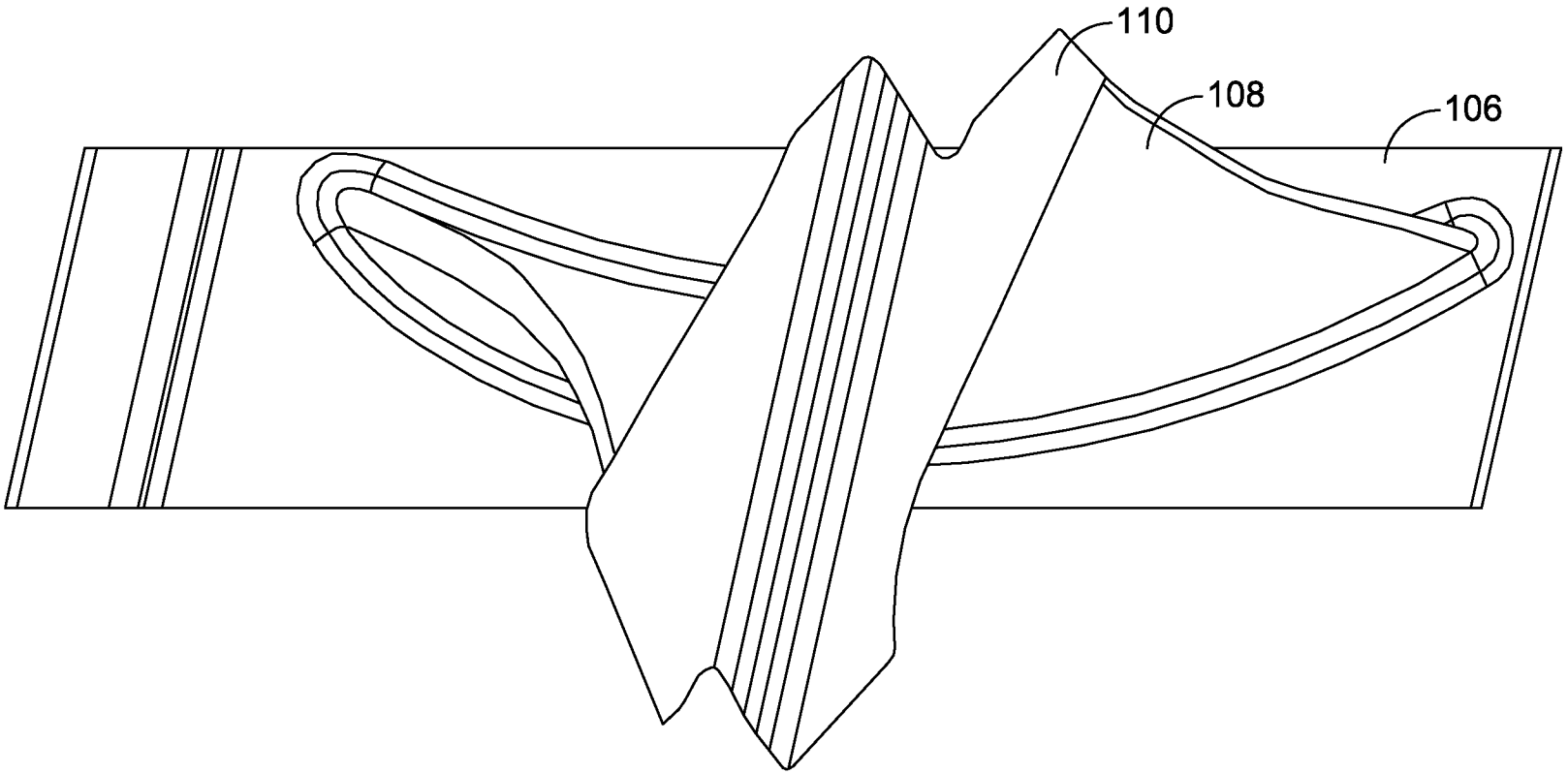
FIG. 3 depicts a top view of an embodiment of the present invention.
Figure 4A:
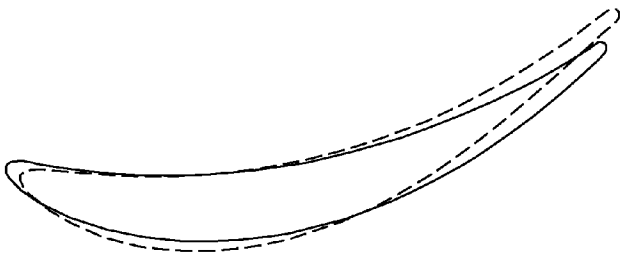
FIG. 4A-4E depicts a series of cross section views taken a various spans along the airfoil comparing the prior art airfoil to an embodiment of the present invention.
Figure 4B:
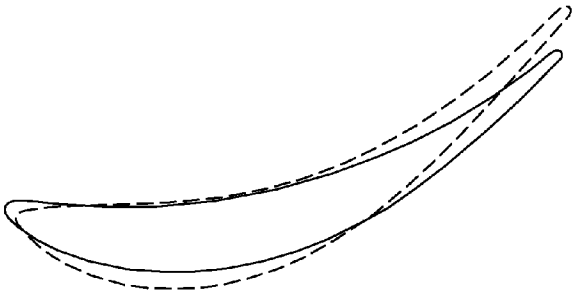
Figure 4C:
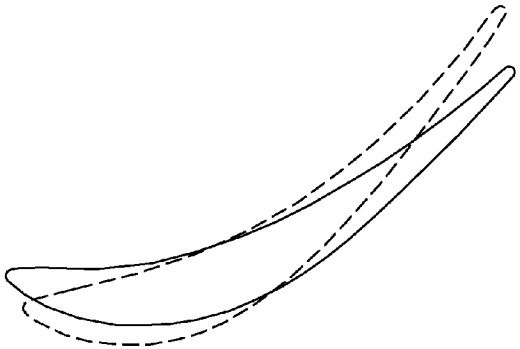
Figure 4D:
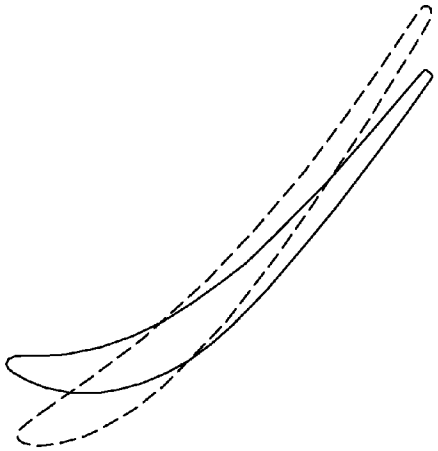
Figure 4E:
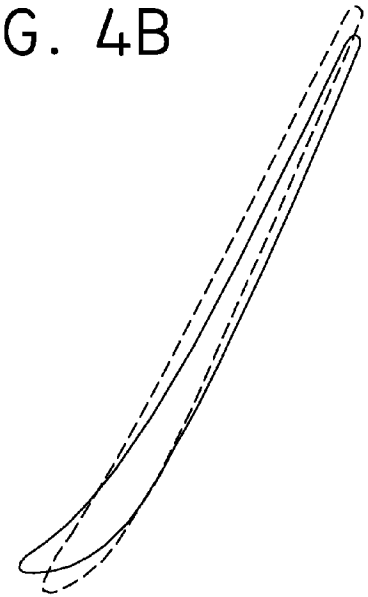
FIG. 4E PRIOR ART

Referring initially to FIGS. 1-3, a turbine blade 100 in accordance with an embodiment of the present invention is disclosed. The turbine blade 100 comprises an attachment 102, a neck 104 extending radially outward from the attachment 102, and a platform 106 extending radially outward from the neck 104. An airfoil 108 extends radially outward from the platform 106 and a shroud 110 extends radially outward from the airfoil 108. The airfoil 108 has an uncoated profile substantially in accordance with Cartesian coordinate values of X, Y, and Z as set forth in Table 1, carried to three decimal places, where Z is a distance measured radially from the platform 106. All coordinate values X, Y, and Z are measured in inches. FIG. 4A-4E depicts a series of airfoil cross sections taken at various span positions for both the prior art blade and the present invention.

The turbine blade 100 also comprises a recessed region 112 that extends along a portion of the axial length of the platform 106 between the platform 106 and the attachment 102. Located within the recessed region 112 is a seal pin 114 that serves to seal any gap between adjacent turbine blades 100.

The turbine blade 100 is fabricated through a casting and machining process. Specifically, in an embodiment of the present invention, the turbine blade is cast from a nickel-based super alloy. Examples of acceptable alloys include, but are not limited to, Rene 80, GTD111, and MGA2400. For the embodiment disclosed herein, the airfoil has a modified profile that results in a volume reduction of approximately 15%. Therefore, for the airfoil profile of the present invention, the blade weight is reduced by approximately four pounds compared to a prior art turbine blade fabricated from CM-247.

As a result of the casting process, the profile of the airfoil 108 can vary typically up to 0.030 inches relative to the nominal coordinates. In order to provide further thermal capability, the airfoil 108 of the turbine blade 100 comprises a MCrAlY bond coating of approximately 0.0055 inches thick, where M can be a variety of metals including, but not limited to Cobalt, Nickel, or a Cobalt Nickel mixture. By application of the bond coating, the turbine blade 100 is achieves an improved oxidation resistance over the prior art configuration.

As previously discussed, FIG. 4A-4E depicts a plurality of section views taken through turbine blade 100 and overlaid on top of section views taken from the prior art turbine blade at the same radial percent span. For example, representative sections are taken at 10% span, 30% span, 50% span, 70% span and the tip of the airfoil adjacent to the shroud. As it can be seen from each of the cross section views, the camber of the airfoil has generally been reduced across the span to essentially "open up" the airfoil compared to the prior art design. This opening effect contributes to the increased throat area for the rotor stage.

Figure 5:
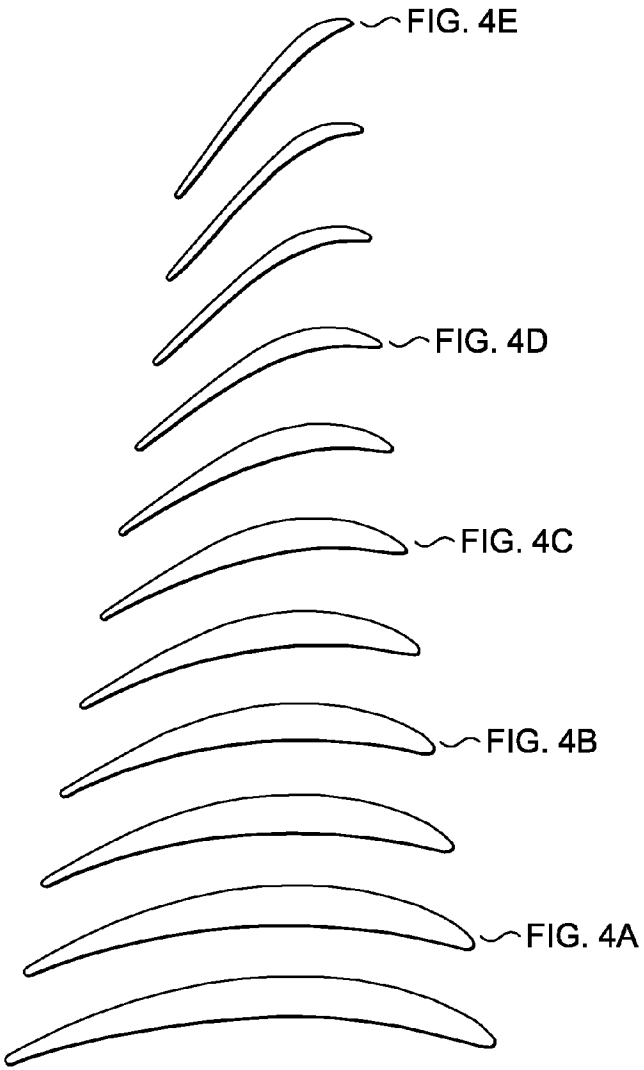
FIG. 5 depicts a perspective view of a series of airfoil sections outlined in the Cartesian Coordinates of Table 1.

The airfoil 108 of the present invention is generated by connecting X,Y coordinates with a smooth arc at a number of Z positions extending radially outward from the blade platform. For the present invention, eleven sections of X,Y coordinate data are first connected together. These sections, some of which are shown in FIG. 5, are then connected together by a series of smooth curves to generate the airfoil surface.

In an alternate embodiment of the present invention, an airfoil for a turbine blade having an uncoated profile substantially in accordance with Cartesian coordinate values of X, Y, and Z as set forth in Table 1 carried to three decimal places. The airfoil 108 is formed by connecting adjacent sections of X, Y coordinate data at a series of Z positions measured radially from a platform. Because the airfoil is cast, there are tolerances in the casting process, and as such the airfoil can vary in profile and position by about +/−0.030 inches.

Figure 8:
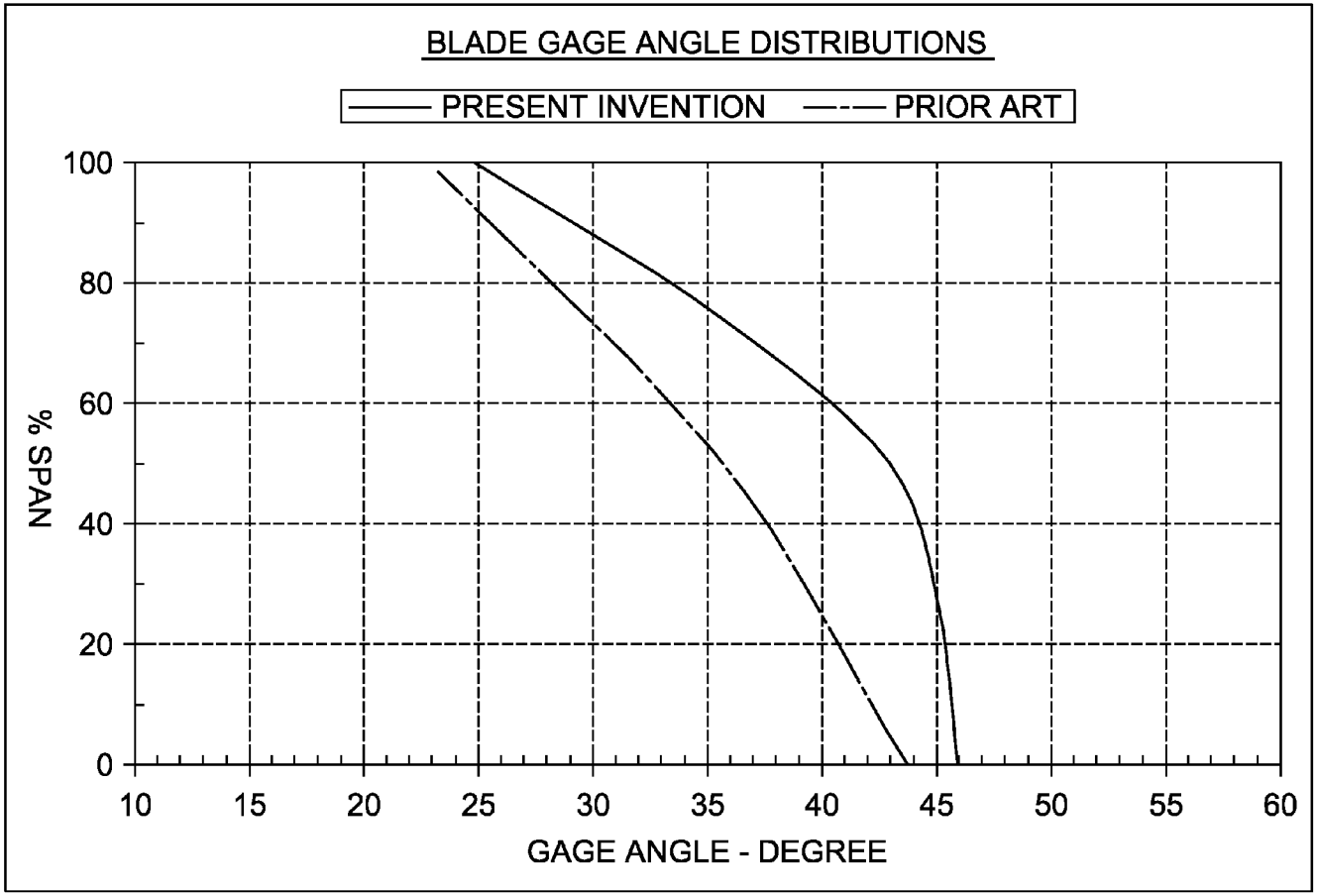
FIG. 8 depicts a chart showing the increase in throat area for each section of the airfoil, as determined by the change in gage angle in accordance with an alternate embodiment of the present invention.
Figure 9:
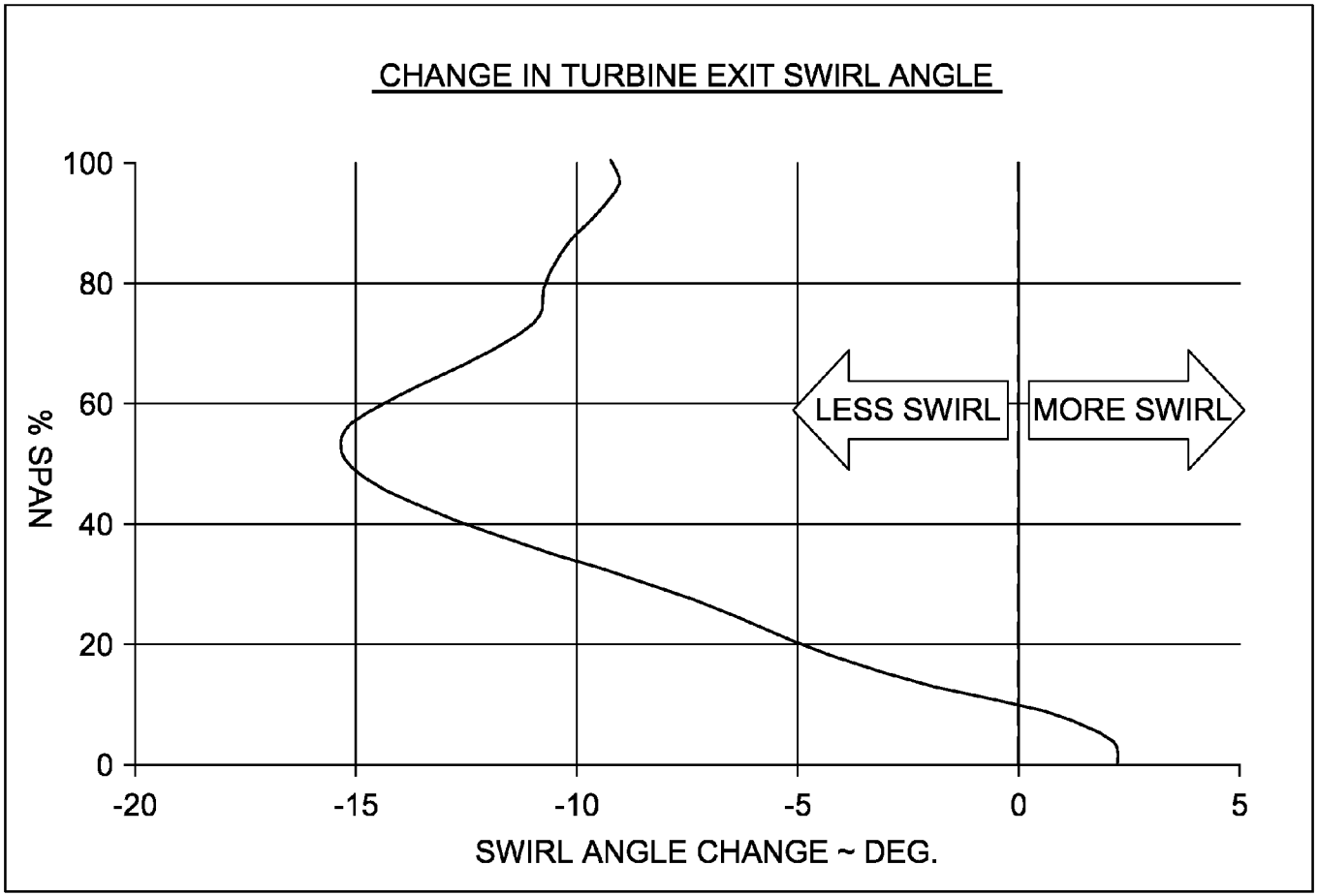
FIG. 9 depicts a chart showing change in turbine exit swirl angle for each section of the airfoil.

In yet another embodiment of the present invention, a plurality of turbine blades 100 are secured to a rotor disk to form a rotor stage. The plurality of turbine blades each have an airfoil having an uncoated profile substantially in accordance with Cartesian Coordinate values of X, Y, and Z as set forth in Table 1. When the profiles of the airfoils for the blades are positioned in the rotor disk, they create a throat area of approximately 3,625 $in^2$ between adjacent airfoils and have a reduced swirl exiting the rotor stage. Referring to FIG. 8, a chart is disclosed depicting the increase in throat area for each section of the airfoil, as determined by the change in gage angle. As a result of the changes the throat area for an embodiment of the present invention increased from approximately 3187 $in^2$ to approximately 3625 $in^2$, or a 13.7% increase.

Where an embodiment of the present invention is used as the last stage of a turbine, the swirl coming off the last stage can limit the rate at which the rotor stage can operate. By opening the blade up to increase the throat area, the flow of air passing therethrough has a smaller swirl imparted to it, and as such, the last stage of the turbine can be pushed to increase output. The present invention is designed to reduce the turbine exit swirl angle to approximately 10 deg. Utilizing an embodiment of the present invention in the last stage of a turbine can result in approximately a 10% increase in power output from the gas turbine engine.

Figure 7:
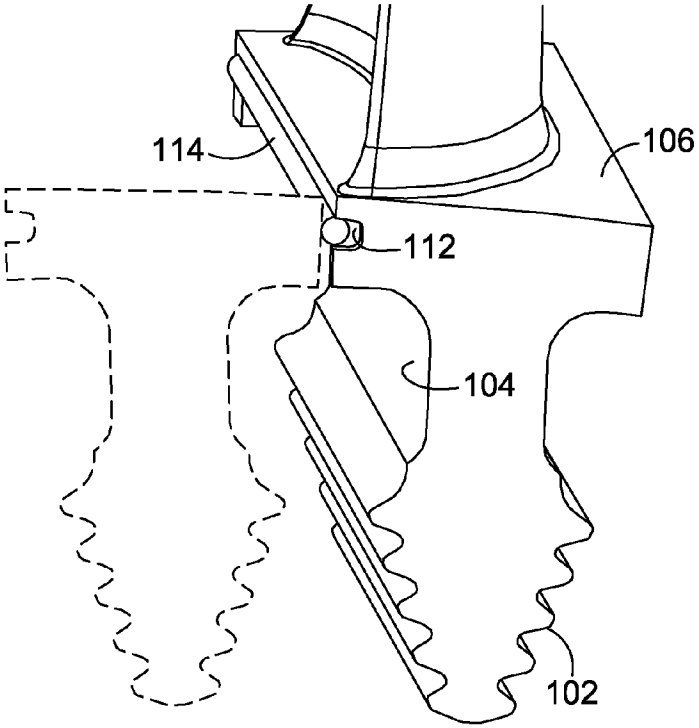
FIG. 7 depicts a portion of a rotor assembly and blade seals taken in a cross section through FIG. 6 in accordance with an alternate embodiment of the present invention.
Figure 6:
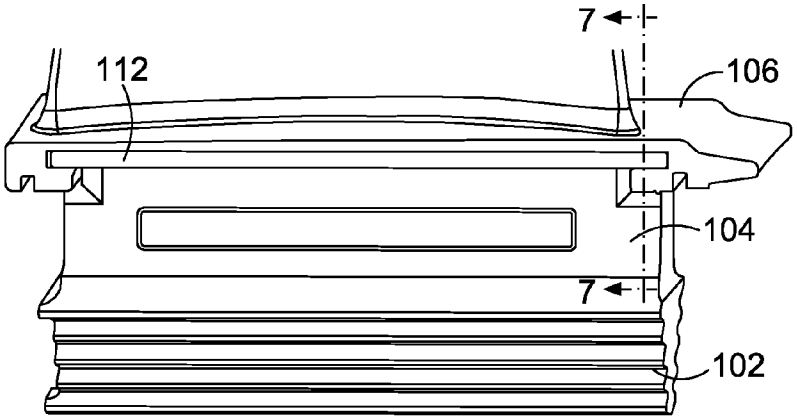
FIG. 6 depicts a portion of a blade root and blade seal passage in an elevation view in accordance with an alternate embodiment of the present invention.

As previously discussed, the turbine blade 100 also utilizes a seal 114 for sealing the axially-extending gap between adjacent platforms 106 in a rotor stage. The seal and its positioning can be seen from FIGS. 6 and 7. Specifically, the seal 114 is positioned in a recessed region 112 of the platform 106, where the recessed region 112 extends axially along a majority of a length of the platform 106. As shown in FIG. 7, when a second turbine blade is positioned adjacent to the seal 114, and the blades are in operation, under centrifugal loading, the gap between mating turbine blades is then blocked by the seal 114.

TABLE 1

| X | Y | Z |
|---|---|---|
| −2.863 | 0.849 | 0.000 |
| −2.727 | 0.794 | 0.000 |
| −2.593 | 0.737 | 0.000 |
| −2.458 | 0.681 | 0.000 |
| −2.322 | 0.627 | 0.000 |
| −2.186 | 0.575 | 0.000 |
| −2.048 | 0.525 | 0.000 |
| −1.910 | 0.478 | 0.000 |
| −1.771 | 0.434 | 0.000 |
| −1.631 | 0.392 | 0.000 |
| −1.490 | 0.354 | 0.000 |
| −1.348 | 0.318 | 0.000 |
| −1.206 | 0.286 | 0.000 |
| −1.063 | 0.256 | 0.000 |
| −0.919 | 0.229 | 0.000 |
| −0.775 | 0.205 | 0.000 |
| −0.631 | 0.184 | 0.000 |
| −0.486 | 0.165 | 0.000 |
| −0.341 | 0.149 | 0.000 |
| −0.195 | 0.136 | 0.000 |
| −0.049 | 0.126 | 0.000 |
| 0.096 | 0.118 | 0.000 |
| 0.242 | 0.113 | 0.000 |
| 0.388 | 0.110 | 0.000 |
| 0.534 | 0.109 | 0.000 |
| 0.681 | 0.111 | 0.000 |
| 0.827 | 0.115 | 0.000 |
| 0.972 | 0.121 | 0.000 |

TABLE 1-continued

| X | Y | Z |
|---|---|---|
| 1.118 | 0.130 | 0.000 |
| 1.264 | 0.141 | 0.000 |
| 1.409 | 0.154 | 0.000 |
| 1.555 | 0.168 | 0.000 |
| 1.700 | 0.185 | 0.000 |
| 1.845 | 0.204 | 0.000 |
| 1.989 | 0.225 | 0.000 |
| 2.134 | 0.248 | 0.000 |
| 2.278 | 0.272 | 0.000 |
| 2.421 | 0.299 | 0.000 |
| 2.565 | 0.327 | 0.000 |
| 2.707 | 0.357 | 0.000 |
| 2.850 | 0.390 | 0.000 |
| 2.992 | 0.424 | 0.000 |
| 3.133 | 0.461 | 0.000 |
| 3.274 | 0.500 | 0.000 |
| 3.414 | 0.543 | 0.000 |
| 3.552 | 0.590 | 0.000 |
| 3.689 | 0.637 | 0.000 |
| 3.744 | 0.526 | 0.000 |
| 3.625 | 0.444 | 0.000 |
| 3.498 | 0.371 | 0.000 |
| 3.371 | 0.300 | 0.000 |
| 3.241 | 0.232 | 0.000 |
| 3.111 | 0.166 | 0.000 |
| 2.979 | 0.103 | 0.000 |
| 2.846 | 0.042 | 0.000 |
| 2.713 | −0.016 | 0.000 |
| 2.578 | −0.072 | 0.000 |
| 2.442 | −0.126 | 0.000 |
| 2.305 | −0.177 | 0.000 |
| 2.167 | −0.226 | 0.000 |
| 2.029 | −0.272 | 0.000 |
| 1.889 | −0.315 | 0.000 |
| 1.749 | −0.355 | 0.000 |
| 1.607 | −0.392 | 0.000 |
| 1.465 | −0.426 | 0.000 |
| 1.323 | −0.457 | 0.000 |
| 1.179 | −0.485 | 0.000 |
| 1.035 | −0.510 | 0.000 |
| 0.891 | −0.532 | 0.000 |
| 0.746 | −0.550 | 0.000 |
| 0.601 | −0.565 | 0.000 |
| 0.455 | −0.576 | 0.000 |
| 0.309 | −0.583 | 0.000 |
| 0.163 | −0.587 | 0.000 |
| 0.017 | −0.588 | 0.000 |
| −0.129 | −0.584 | 0.000 |
| −0.275 | −0.577 | 0.000 |
| −0.420 | −0.565 | 0.000 |
| −0.566 | −0.550 | 0.000 |
| −0.710 | −0.530 | 0.000 |
| −0.854 | −0.507 | 0.000 |
| −0.998 | −0.479 | 0.000 |
| −1.140 | −0.447 | 0.000 |
| −1.282 | −0.411 | 0.000 |
| −1.422 | −0.370 | 0.000 |
| −1.561 | −0.325 | 0.000 |
| −1.698 | −0.275 | 0.000 |
| −1.834 | −0.220 | 0.000 |
| −1.967 | −0.161 | 0.000 |
| −2.099 | −0.097 | 0.000 |
| −2.227 | −0.028 | 0.000 |
| −2.353 | 0.046 | 0.000 |
| −2.475 | 0.126 | 0.000 |
| −2.594 | 0.212 | 0.000 |
| −2.707 | 0.304 | 0.000 |
| −2.814 | 0.403 | 0.000 |
| −2.913 | 0.510 | 0.000 |
| −3.001 | 0.627 | 0.000 |
| −3.065 | 0.758 | 0.000 |
| −3.006 | 0.870 | 0.000 |
| −2.610 | 0.728 | 2.000 |
| −2.483 | 0.677 | 2.000 |
| −2.357 | 0.627 | 2.000 |
| −2.230 | 0.579 | 2.000 |
| −2.102 | 0.534 | 2.000 |
| −1.973 | 0.491 | 2.000 |

TABLE 1-continued

| X | Y | Z |
|---|---|---|
| −1.843 | 0.450 | 2.000 |
| −1.713 | 0.412 | 2.000 |
| −1.582 | 0.375 | 2.000 |
| −1.450 | 0.341 | 2.000 |
| −1.318 | 0.310 | 2.000 |
| −1.185 | 0.280 | 2.000 |
| −1.052 | 0.253 | 2.000 |
| −0.919 | 0.228 | 2.000 |
| −0.785 | 0.205 | 2.000 |
| −0.650 | 0.185 | 2.000 |
| −0.515 | 0.167 | 2.000 |
| −0.380 | 0.152 | 2.000 |
| −0.245 | 0.138 | 2.000 |
| −0.110 | 0.128 | 2.000 |
| 0.026 | 0.119 | 2.000 |
| 0.162 | 0.113 | 2.000 |
| 0.298 | 0.109 | 2.000 |
| 0.434 | 0.108 | 2.000 |
| 0.569 | 0.109 | 2.000 |
| 0.705 | 0.112 | 2.000 |
| 0.841 | 0.118 | 2.000 |
| 0.977 | 0.127 | 2.000 |
| 1.112 | 0.137 | 2.000 |
| 1.248 | 0.150 | 2.000 |
| 1.383 | 0.165 | 2.000 |
| 1.517 | 0.182 | 2.000 |
| 1.652 | 0.202 | 2.000 |
| 1.786 | 0.224 | 2.000 |
| 1.920 | 0.248 | 2.000 |
| 2.053 | 0.274 | 2.000 |
| 2.186 | 0.303 | 2.000 |
| 2.319 | 0.333 | 2.000 |
| 2.451 | 0.366 | 2.000 |
| 2.582 | 0.400 | 2.000 |
| 2.713 | 0.437 | 2.000 |
| 2.843 | 0.476 | 2.000 |
| 2.973 | 0.517 | 2.000 |
| 3.102 | 0.560 | 2.000 |
| 3.229 | 0.606 | 2.000 |
| 3.356 | 0.656 | 2.000 |
| 3.483 | 0.690 | 2.000 |
| 3.499 | 0.577 | 2.000 |
| 3.384 | 0.504 | 2.000 |
| 3.267 | 0.434 | 2.000 |
| 3.150 | 0.366 | 2.000 |
| 3.031 | 0.300 | 2.000 |
| 2.912 | 0.236 | 2.000 |
| 2.791 | 0.173 | 2.000 |
| 2.670 | 0.111 | 2.000 |
| 2.547 | 0.052 | 2.000 |
| 2.424 | −0.006 | 2.000 |
| 2.300 | −0.062 | 2.000 |
| 2.176 | −0.115 | 2.000 |
| 2.050 | −0.166 | 2.000 |
| 1.923 | −0.215 | 2.000 |
| 1.794 | −0.260 | 2.000 |
| 1.665 | −0.303 | 2.000 |
| 1.536 | −0.343 | 2.000 |
| 1.405 | −0.380 | 2.000 |
| 1.273 | −0.414 | 2.000 |
| 1.141 | −0.445 | 2.000 |
| 1.008 | −0.473 | 2.000 |
| 0.874 | −0.498 | 2.000 |
| 0.740 | −0.519 | 2.000 |
| 0.605 | −0.536 | 2.000 |
| 0.470 | −0.551 | 2.000 |
| 0.334 | −0.562 | 2.000 |
| 0.199 | −0.569 | 2.000 |
| 0.063 | −0.572 | 2.000 |
| −0.073 | −0.572 | 2.000 |
| −0.209 | −0.568 | 2.000 |
| −0.345 | −0.560 | 2.000 |
| −0.480 | −0.549 | 2.000 |
| −0.615 | −0.533 | 2.000 |
| −0.750 | −0.514 | 2.000 |
| −0.884 | −0.490 | 2.000 |
| −1.017 | −0.462 | 2.000 |
| −1.149 | −0.431 | 2.000 |

TABLE 1-continued

| X | Y | Z |
|---|---|---|
| −1.280 | −0.395 | 2.000 |
| −1.410 | −0.354 | 2.000 |
| −1.538 | −0.310 | 2.000 |
| −1.665 | −0.261 | 2.000 |
| −1.790 | −0.207 | 2.000 |
| −1.912 | −0.149 | 2.000 |
| −2.033 | −0.085 | 2.000 |
| −2.150 | −0.017 | 2.000 |
| −2.264 | 0.056 | 2.000 |
| −2.375 | 0.136 | 2.000 |
| −2.481 | 0.221 | 2.000 |
| −2.580 | 0.314 | 2.000 |
| −2.672 | 0.414 | 2.000 |
| −2.752 | 0.524 | 2.000 |
| −2.809 | 0.646 | 2.000 |
| −2.743 | 0.746 | 2.000 |
| −2.363 | 0.614 | 4.000 |
| −2.244 | 0.571 | 4.000 |
| −2.126 | 0.527 | 4.000 |
| −2.007 | 0.485 | 4.000 |
| −1.887 | 0.446 | 4.000 |
| −1.766 | 0.409 | 4.000 |
| −1.645 | 0.374 | 4.000 |
| −1.523 | 0.341 | 4.000 |
| −1.400 | 0.310 | 4.000 |
| −1.277 | 0.282 | 4.000 |
| −1.154 | 0.255 | 4.000 |
| −1.030 | 0.231 | 4.000 |
| −0.906 | 0.209 | 4.000 |
| −0.781 | 0.188 | 4.000 |
| −0.656 | 0.170 | 4.000 |
| −0.531 | 0.154 | 4.000 |
| −0.405 | 0.140 | 4.000 |
| −0.280 | 0.129 | 4.000 |
| −0.154 | 0.119 | 4.000 |
| −0.028 | 0.112 | 4.000 |
| 0.099 | 0.106 | 4.000 |
| 0.225 | 0.103 | 4.000 |
| 0.351 | 0.103 | 4.000 |
| 0.477 | 0.104 | 4.000 |
| 0.604 | 0.108 | 4.000 |
| 0.730 | 0.114 | 4.000 |
| 0.856 | 0.122 | 4.000 |
| 0.981 | 0.133 | 4.000 |
| 1.107 | 0.146 | 4.000 |
| 1.232 | 0.161 | 4.000 |
| 1.358 | 0.178 | 4.000 |
| 1.482 | 0.198 | 4.000 |
| 1.607 | 0.220 | 4.000 |
| 1.730 | 0.245 | 4.000 |
| 1.854 | 0.271 | 4.000 |
| 1.977 | 0.300 | 4.000 |
| 2.099 | 0.332 | 4.000 |
| 2.221 | 0.366 | 4.000 |
| 2.342 | 0.402 | 4.000 |
| 2.462 | 0.440 | 4.000 |
| 2.582 | 0.481 | 4.000 |
| 2.700 | 0.524 | 4.000 |
| 2.818 | 0.569 | 4.000 |
| 2.935 | 0.617 | 4.000 |
| 3.051 | 0.667 | 4.000 |
| 3.166 | 0.720 | 4.000 |
| 3.282 | 0.742 | 4.000 |
| 3.270 | 0.638 | 4.000 |
| 3.164 | 0.570 | 4.000 |
| 3.057 | 0.504 | 4.000 |
| 2.949 | 0.438 | 4.000 |
| 2.840 | 0.375 | 4.000 |
| 2.730 | 0.312 | 4.000 |
| 2.620 | 0.250 | 4.000 |
| 2.509 | 0.190 | 4.000 |
| 2.398 | 0.131 | 4.000 |
| 2.286 | 0.073 | 4.000 |
| 2.173 | 0.016 | 4.000 |
| 2.059 | −0.039 | 4.000 |
| 1.944 | −0.091 | 4.000 |
| 1.829 | −0.142 | 4.000 |
| 1.712 | −0.191 | 4.000 |

TABLE 1-continued

| X | Y | Z |
|---|---|---|
| 1.594 | −0.236 | 4.000 |
| 1.476 | −0.280 | 4.000 |
| 1.356 | −0.320 | 4.000 |
| 1.236 | −0.358 | 4.000 |
| 1.115 | −0.393 | 4.000 |
| 0.992 | −0.424 | 4.000 |
| 0.869 | −0.453 | 4.000 |
| 0.746 | −0.478 | 4.000 |
| 0.621 | −0.499 | 4.000 |
| 0.496 | −0.518 | 4.000 |
| 0.371 | −0.532 | 4.000 |
| 0.245 | −0.543 | 4.000 |
| 0.119 | −0.551 | 4.000 |
| −0.007 | −0.555 | 4.000 |
| −0.133 | −0.555 | 4.000 |
| −0.259 | −0.551 | 4.000 |
| −0.385 | −0.544 | 4.000 |
| −0.511 | −0.532 | 4.000 |
| −0.637 | −0.517 | 4.000 |
| −0.761 | −0.498 | 4.000 |
| −0.885 | −0.475 | 4.000 |
| −1.009 | −0.448 | 4.000 |
| −1.131 | −0.416 | 4.000 |
| −1.252 | −0.381 | 4.000 |
| −1.372 | −0.341 | 4.000 |
| −1.490 | −0.297 | 4.000 |
| −1.607 | −0.249 | 4.000 |
| −1.722 | −0.196 | 4.000 |
| −1.834 | −0.139 | 4.000 |
| −1.944 | −0.076 | 4.000 |
| −2.050 | −0.009 | 4.000 |
| −2.153 | 0.064 | 4.000 |
| −2.252 | 0.143 | 4.000 |
| −2.345 | 0.229 | 4.000 |
| −2.430 | 0.322 | 4.000 |
| −2.505 | 0.423 | 4.000 |
| −2.555 | 0.538 | 4.000 |
| −2.488 | 0.627 | 4.000 |
| −2.140 | 0.494 | 6.000 |
| −2.029 | 0.459 | 6.000 |
| −1.919 | 0.421 | 6.000 |
| −1.807 | 0.385 | 6.000 |
| −1.696 | 0.350 | 6.000 |
| −1.583 | 0.318 | 6.000 |
| −1.470 | 0.288 | 6.000 |
| −1.357 | 0.259 | 6.000 |
| −1.243 | 0.233 | 6.000 |
| −1.128 | 0.210 | 6.000 |
| −1.013 | 0.188 | 6.000 |
| −0.898 | 0.169 | 6.000 |
| −0.782 | 0.152 | 6.000 |
| −0.666 | 0.137 | 6.000 |
| −0.550 | 0.125 | 6.000 |
| −0.434 | 0.114 | 6.000 |
| −0.317 | 0.105 | 6.000 |
| −0.200 | 0.099 | 6.000 |
| −0.083 | 0.095 | 6.000 |
| 0.034 | 0.093 | 6.000 |
| 0.151 | 0.093 | 6.000 |
| 0.267 | 0.095 | 6.000 |
| 0.384 | 0.100 | 6.000 |
| 0.501 | 0.106 | 6.000 |
| 0.618 | 0.115 | 6.000 |
| 0.734 | 0.125 | 6.000 |
| 0.850 | 0.138 | 6.000 |
| 0.966 | 0.153 | 6.000 |
| 1.082 | 0.170 | 6.000 |
| 1.197 | 0.189 | 6.000 |
| 1.312 | 0.211 | 6.000 |
| 1.427 | 0.234 | 6.000 |
| 1.541 | 0.259 | 6.000 |
| 1.655 | 0.287 | 6.000 |
| 1.768 | 0.317 | 6.000 |
| 1.880 | 0.348 | 6.000 |
| 1.992 | 0.382 | 6.000 |
| 2.104 | 0.418 | 6.000 |
| 2.214 | 0.456 | 6.000 |
| 2.324 | 0.497 | 6.000 |

TABLE 1-continued

| X | Y | Z |
|---|---|---|
| 2.433 | 0.539 | 6.000 |
| 2.541 | 0.584 | 6.000 |
| 2.648 | 0.630 | 6.000 |
| 2.754 | 0.679 | 6.000 |
| 2.859 | 0.731 | 6.000 |
| 2.963 | 0.785 | 6.000 |
| 3.066 | 0.783 | 6.000 |
| 3.023 | 0.691 | 6.000 |
| 2.924 | 0.628 | 6.000 |
| 2.826 | 0.565 | 6.000 |
| 2.726 | 0.504 | 6.000 |
| 2.626 | 0.443 | 6.000 |
| 2.526 | 0.383 | 6.000 |
| 2.425 | 0.324 | 6.000 |
| 2.324 | 0.265 | 6.000 |
| 2.222 | 0.208 | 6.000 |
| 2.120 | 0.151 | 6.000 |
| 2.017 | 0.095 | 6.000 |
| 1.914 | 0.040 | 6.000 |
| 1.810 | −0.013 | 6.000 |
| 1.705 | −0.066 | 6.000 |
| 1.600 | −0.116 | 6.000 |
| 1.493 | −0.165 | 6.000 |
| 1.386 | −0.211 | 6.000 |
| 1.278 | −0.255 | 6.000 |
| 1.168 | −0.297 | 6.000 |
| 1.058 | −0.335 | 6.000 |
| 0.947 | −0.371 | 6.000 |
| 0.834 | −0.404 | 6.000 |
| 0.721 | −0.433 | 6.000 |
| 0.607 | −0.459 | 6.000 |
| 0.492 | −0.482 | 6.000 |
| 0.377 | −0.501 | 6.000 |
| 0.261 | −0.517 | 6.000 |
| 0.145 | −0.529 | 6.000 |
| 0.028 | −0.537 | 6.000 |
| −0.089 | −0.542 | 6.000 |
| −0.206 | −0.543 | 6.000 |
| −0.322 | −0.540 | 6.000 |
| −0.439 | −0.533 | 6.000 |
| −0.556 | −0.522 | 6.000 |
| −0.672 | −0.507 | 6.000 |
| −0.787 | −0.489 | 6.000 |
| −0.902 | −0.466 | 6.000 |
| −1.016 | −0.439 | 6.000 |
| −1.128 | −0.408 | 6.000 |
| −1.240 | −0.373 | 6.000 |
| −1.350 | −0.334 | 6.000 |
| −1.459 | −0.291 | 6.000 |
| −1.566 | −0.243 | 6.000 |
| −1.670 | −0.191 | 6.000 |
| −1.772 | −0.133 | 6.000 |
| −1.871 | −0.071 | 6.000 |
| −1.967 | −0.004 | 6.000 |
| −2.058 | 0.068 | 6.000 |
| −2.145 | 0.147 | 6.000 |
| −2.224 | 0.233 | 6.000 |
| −2.294 | 0.327 | 6.000 |
| −2.335 | 0.435 | 6.000 |
| −2.256 | 0.505 | 6.000 |
| −1.970 | 0.358 | 8.000 |
| −1.866 | 0.329 | 8.000 |
| −1.763 | 0.297 | 8.000 |
| −1.660 | 0.265 | 8.000 |
| −1.556 | 0.235 | 8.000 |
| −1.451 | 0.208 | 8.000 |
| −1.346 | 0.182 | 8.000 |
| −1.241 | 0.159 | 8.000 |
| −1.134 | 0.139 | 8.000 |
| −1.028 | 0.121 | 8.000 |
| −0.921 | 0.106 | 8.000 |
| −0.814 | 0.092 | 8.000 |
| −0.706 | 0.082 | 8.000 |
| −0.598 | 0.074 | 8.000 |
| −0.490 | 0.068 | 8.000 |
| −0.382 | 0.064 | 8.000 |
| −0.274 | 0.063 | 8.000 |
| −0.166 | 0.064 | 8.000 |

TABLE 1-continued

| X | Y | Z |
|---|---|---|
| −0.058 | 0.067 | 8.000 |
| 0.050 | 0.072 | 8.000 |
| 0.157 | 0.080 | 8.000 |
| 0.265 | 0.089 | 8.000 |
| 0.373 | 0.100 | 8.000 |
| 0.480 | 0.114 | 8.000 |
| 0.587 | 0.129 | 8.000 |
| 0.694 | 0.146 | 8.000 |
| 0.800 | 0.165 | 8.000 |
| 0.906 | 0.186 | 8.000 |
| 1.012 | 0.209 | 8.000 |
| 1.117 | 0.233 | 8.000 |
| 1.222 | 0.259 | 8.000 |
| 1.326 | 0.287 | 8.000 |
| 1.430 | 0.317 | 8.000 |
| 1.534 | 0.348 | 8.000 |
| 1.637 | 0.381 | 8.000 |
| 1.739 | 0.415 | 8.000 |
| 1.841 | 0.451 | 8.000 |
| 1.942 | 0.488 | 8.000 |
| 2.043 | 0.528 | 8.000 |
| 2.143 | 0.568 | 8.000 |
| 2.243 | 0.611 | 8.000 |
| 2.341 | 0.655 | 8.000 |
| 2.439 | 0.700 | 8.000 |
| 2.537 | 0.747 | 8.000 |
| 2.633 | 0.796 | 8.000 |
| 2.728 | 0.847 | 8.000 |
| 2.818 | 0.825 | 8.000 |
| 2.761 | 0.745 | 8.000 |
| 2.670 | 0.686 | 8.000 |
| 2.580 | 0.628 | 8.000 |
| 2.488 | 0.569 | 8.000 |
| 2.397 | 0.511 | 8.000 |
| 2.306 | 0.454 | 8.000 |
| 2.214 | 0.397 | 8.000 |
| 2.121 | 0.341 | 8.000 |
| 2.029 | 0.285 | 8.000 |
| 1.936 | 0.230 | 8.000 |
| 1.842 | 0.176 | 8.000 |
| 1.749 | 0.122 | 8.000 |
| 1.655 | 0.069 | 8.000 |
| 1.560 | 0.016 | 8.000 |
| 1.465 | −0.035 | 8.000 |
| 1.370 | −0.086 | 8.000 |
| 1.273 | −0.135 | 8.000 |
| 1.176 | −0.182 | 8.000 |
| 1.078 | −0.227 | 8.000 |
| 0.978 | −0.270 | 8.000 |
| 0.878 | −0.310 | 8.000 |
| 0.777 | −0.347 | 8.000 |
| 0.674 | −0.382 | 8.000 |
| 0.571 | −0.414 | 8.000 |
| 0.467 | −0.442 | 8.000 |
| 0.362 | −0.468 | 8.000 |
| 0.256 | −0.490 | 8.000 |
| 0.149 | −0.508 | 8.000 |
| 0.042 | −0.522 | 8.000 |
| −0.065 | −0.533 | 8.000 |
| −0.173 | −0.540 | 8.000 |
| −0.281 | −0.543 | 8.000 |
| −0.389 | −0.542 | 8.000 |
| −0.497 | −0.537 | 8.000 |
| −0.605 | −0.528 | 8.000 |
| −0.712 | −0.515 | 8.000 |
| −0.819 | −0.498 | 8.000 |
| −0.925 | −0.476 | 8.000 |
| −1.030 | −0.451 | 8.000 |
| −1.134 | −0.421 | 8.000 |
| −1.236 | −0.387 | 8.000 |
| −1.337 | −0.349 | 8.000 |
| −1.437 | −0.307 | 8.000 |
| −1.534 | −0.260 | 8.000 |
| −1.629 | −0.208 | 8.000 |
| −1.721 | −0.152 | 8.000 |
| −1.811 | −0.091 | 8.000 |
| −1.896 | −0.025 | 8.000 |
| −1.977 | 0.046 | 8.000 |

TABLE 1-continued

| X | Y | Z |
|---|---|---|
| −2.052 | 0.124 | 8.000 |
| −2.119 | 0.209 | 8.000 |
| −2.156 | 0.309 | 8.000 |
| −2.077 | 0.368 | 8.000 |
| −1.833 | 0.203 | 10.000 |
| −1.735 | 0.180 | 10.000 |
| −1.639 | 0.153 | 10.000 |
| −1.543 | 0.126 | 10.000 |
| −1.446 | 0.100 | 10.000 |
| −1.349 | 0.077 | 10.000 |
| −1.251 | 0.057 | 10.000 |
| −1.153 | 0.040 | 10.000 |
| −1.054 | 0.025 | 10.000 |
| −0.954 | 0.014 | 10.000 |
| −0.854 | 0.006 | 10.000 |
| −0.755 | 0.001 | 10.000 |
| −0.655 | −0.002 | 10.000 |
| −0.555 | −0.002 | 10.000 |
| −0.455 | 0.001 | 10.000 |
| −0.355 | 0.006 | 10.000 |
| −0.255 | 0.013 | 10.000 |
| −0.156 | 0.023 | 10.000 |
| −0.056 | 0.034 | 10.000 |
| 0.043 | 0.048 | 10.000 |
| 0.142 | 0.064 | 10.000 |
| 0.240 | 0.082 | 10.000 |
| 0.338 | 0.101 | 10.000 |
| 0.436 | 0.122 | 10.000 |
| 0.533 | 0.145 | 10.000 |
| 0.630 | 0.169 | 10.000 |
| 0.727 | 0.195 | 10.000 |
| 0.823 | 0.222 | 10.000 |
| 0.919 | 0.251 | 10.000 |
| 1.014 | 0.281 | 10.000 |
| 1.109 | 0.312 | 10.000 |
| 1.204 | 0.344 | 10.000 |
| 1.298 | 0.378 | 10.000 |
| 1.392 | 0.413 | 10.000 |
| 1.485 | 0.449 | 10.000 |
| 1.578 | 0.486 | 10.000 |
| 1.670 | 0.524 | 10.000 |
| 1.762 | 0.564 | 10.000 |
| 1.854 | 0.604 | 10.000 |
| 1.945 | 0.645 | 10.000 |
| 2.035 | 0.688 | 10.000 |
| 2.125 | 0.731 | 10.000 |
| 2.215 | 0.776 | 10.000 |
| 2.304 | 0.821 | 10.000 |
| 2.392 | 0.868 | 10.000 |
| 2.480 | 0.917 | 10.000 |
| 2.563 | 0.899 | 10.000 |
| 2.514 | 0.822 | 10.000 |
| 2.432 | 0.765 | 10.000 |
| 2.350 | 0.708 | 10.000 |
| 2.268 | 0.652 | 10.000 |
| 2.185 | 0.596 | 10.000 |
| 2.101 | 0.540 | 10.000 |
| 2.018 | 0.485 | 10.000 |
| 1.934 | 0.430 | 10.000 |
| 1.850 | 0.376 | 10.000 |
| 1.766 | 0.322 | 10.000 |
| 1.682 | 0.269 | 10.000 |
| 1.597 | 0.216 | 10.000 |
| 1.511 | 0.164 | 10.000 |
| 1.426 | 0.112 | 10.000 |
| 1.340 | 0.060 | 10.000 |
| 1.254 | 0.009 | 10.000 |
| 1.168 | −0.041 | 10.000 |
| 1.081 | −0.090 | 10.000 |
| 0.993 | −0.139 | 10.000 |
| 0.905 | −0.186 | 10.000 |
| 0.816 | −0.231 | 10.000 |
| 0.725 | −0.274 | 10.000 |
| 0.634 | −0.315 | 10.000 |
| 0.542 | −0.353 | 10.000 |
| 0.448 | −0.389 | 10.000 |
| 0.354 | −0.422 | 10.000 |
| 0.258 | −0.451 | 10.000 |

TABLE 1-continued

| X | Y | Z |
|---|---|---|
| 0.162 | −0.477 | 10.000 |
| 0.065 | −0.500 | 10.000 |
| −0.034 | −0.519 | 10.000 |
| −0.132 | −0.535 | 10.000 |
| −0.232 | −0.546 | 10.000 |
| −0.331 | −0.554 | 10.000 |
| −0.431 | −0.557 | 10.000 |
| −0.531 | −0.557 | 10.000 |
| −0.631 | −0.552 | 10.000 |
| −0.731 | −0.543 | 10.000 |
| −0.830 | −0.529 | 10.000 |
| −0.928 | −0.511 | 10.000 |
| −1.026 | −0.489 | 10.000 |
| −1.122 | −0.462 | 10.000 |
| −1.217 | −0.431 | 10.000 |
| −1.310 | −0.395 | 10.000 |
| −1.402 | −0.355 | 10.000 |
| −1.491 | −0.310 | 10.000 |
| −1.578 | −0.261 | 10.000 |
| −1.662 | −0.206 | 10.000 |
| −1.743 | −0.148 | 10.000 |
| −1.820 | −0.084 | 10.000 |
| −1.892 | −0.014 | 10.000 |
| −1.957 | 0.061 | 10.000 |
| −2.000 | 0.150 | 10.000 |
| −1.932 | 0.209 | 10.000 |
| −1.702 | 0.030 | 12.000 |
| −1.611 | 0.012 | 12.000 |
| −1.521 | −0.011 | 12.000 |
| −1.430 | −0.034 | 12.000 |
| −1.339 | −0.055 | 12.000 |
| −1.248 | −0.073 | 12.000 |
| −1.156 | −0.087 | 12.000 |
| −1.063 | −0.098 | 12.000 |
| −0.970 | −0.105 | 12.000 |
| −0.877 | −0.108 | 12.000 |
| −0.784 | −0.109 | 12.000 |
| −0.691 | −0.106 | 12.000 |
| −0.598 | −0.100 | 12.000 |
| −0.505 | −0.091 | 12.000 |
| −0.413 | −0.080 | 12.000 |
| −0.321 | −0.066 | 12.000 |
| −0.229 | −0.050 | 12.000 |
| −0.137 | −0.031 | 12.000 |
| −0.047 | −0.011 | 12.000 |
| 0.044 | 0.012 | 12.000 |
| 0.134 | 0.036 | 12.000 |
| 0.223 | 0.062 | 12.000 |
| 0.313 | 0.089 | 12.000 |
| 0.401 | 0.118 | 12.000 |
| 0.489 | 0.148 | 12.000 |
| 0.577 | 0.180 | 12.000 |
| 0.664 | 0.212 | 12.000 |
| 0.751 | 0.246 | 12.000 |
| 0.837 | 0.282 | 12.000 |
| 0.923 | 0.318 | 12.000 |
| 1.009 | 0.355 | 12.000 |
| 1.094 | 0.393 | 12.000 |
| 1.178 | 0.432 | 12.000 |
| 1.262 | 0.472 | 12.000 |
| 1.346 | 0.513 | 12.000 |
| 1.429 | 0.555 | 12.000 |
| 1.512 | 0.597 | 12.000 |
| 1.595 | 0.640 | 12.000 |
| 1.677 | 0.684 | 12.000 |
| 1.759 | 0.729 | 12.000 |
| 1.840 | 0.774 | 12.000 |
| 1.921 | 0.820 | 12.000 |
| 2.002 | 0.867 | 12.000 |
| 2.082 | 0.915 | 12.000 |
| 2.162 | 0.964 | 12.000 |
| 2.240 | 1.014 | 12.000 |
| 2.323 | 1.028 | 12.000 |
| 2.311 | 0.949 | 12.000 |
| 2.238 | 0.891 | 12.000 |
| 2.164 | 0.834 | 12.000 |
| 2.090 | 0.778 | 12.000 |
| 2.016 | 0.721 | 12.000 |

TABLE 1-continued

| X | Y | Z |
|---|---|---|
| 1.941 | 0.666 | 12.000 |
| 1.866 | 0.610 | 12.000 |
| 1.791 | 0.556 | 12.000 |
| 1.715 | 0.501 | 12.000 |
| 1.639 | 0.447 | 12.000 |
| 1.563 | 0.393 | 12.000 |
| 1.487 | 0.340 | 12.000 |
| 1.410 | 0.287 | 12.000 |
| 1.333 | 0.234 | 12.000 |
| 1.255 | 0.183 | 12.000 |
| 1.178 | 0.131 | 12.000 |
| 1.100 | 0.080 | 12.000 |
| 1.021 | 0.029 | 12.000 |
| 0.943 | −0.021 | 12.000 |
| 0.864 | −0.071 | 12.000 |
| 0.785 | −0.120 | 12.000 |
| 0.705 | −0.168 | 12.000 |
| 0.624 | −0.214 | 12.000 |
| 0.543 | −0.260 | 12.000 |
| 0.460 | −0.303 | 12.000 |
| 0.377 | −0.344 | 12.000 |
| 0.292 | −0.382 | 12.000 |
| 0.206 | −0.418 | 12.000 |
| 0.118 | −0.451 | 12.000 |
| 0.030 | −0.481 | 12.000 |
| −0.059 | −0.507 | 12.000 |
| −0.150 | −0.530 | 12.000 |
| −0.241 | −0.549 | 12.000 |
| −0.333 | −0.564 | 12.000 |
| −0.425 | −0.576 | 12.000 |
| −0.518 | −0.583 | 12.000 |
| −0.611 | −0.585 | 12.000 |
| −0.704 | −0.583 | 12.000 |
| −0.797 | −0.577 | 12.000 |
| −0.890 | −0.565 | 12.000 |
| −0.982 | −0.549 | 12.000 |
| −1.072 | −0.528 | 12.000 |
| −1.162 | −0.502 | 12.000 |
| −1.250 | −0.471 | 12.000 |
| −1.336 | −0.435 | 12.000 |
| −1.419 | −0.394 | 12.000 |
| −1.500 | −0.347 | 12.000 |
| −1.578 | −0.296 | 12.000 |
| −1.653 | −0.240 | 12.000 |
| −1.723 | −0.179 | 12.000 |
| −1.788 | −0.112 | 12.000 |
| −1.841 | −0.036 | 12.000 |
| −1.795 | 0.032 | 12.000 |
| −1.590 | −0.166 | 14.000 |
| −1.503 | −0.180 | 14.000 |
| −1.417 | −0.199 | 14.000 |
| −1.331 | −0.217 | 14.000 |
| −1.245 | −0.232 | 14.000 |
| −1.158 | −0.244 | 14.000 |
| −1.070 | −0.251 | 14.000 |
| −0.982 | −0.254 | 14.000 |
| −0.895 | −0.254 | 14.000 |
| −0.807 | −0.249 | 14.000 |
| −0.719 | −0.241 | 14.000 |
| −0.632 | −0.230 | 14.000 |
| −0.546 | −0.215 | 14.000 |
| −0.459 | −0.198 | 14.000 |
| −0.374 | −0.178 | 14.000 |
| −0.289 | −0.155 | 14.000 |
| −0.205 | −0.130 | 14.000 |
| −0.121 | −0.103 | 14.000 |
| −0.038 | −0.074 | 14.000 |
| 0.044 | −0.043 | 14.000 |
| 0.125 | −0.010 | 14.000 |
| 0.206 | 0.024 | 14.000 |
| 0.286 | 0.060 | 14.000 |
| 0.366 | 0.097 | 14.000 |
| 0.445 | 0.136 | 14.000 |
| 0.523 | 0.176 | 14.000 |
| 0.601 | 0.216 | 14.000 |
| 0.678 | 0.258 | 14.000 |
| 0.755 | 0.301 | 14.000 |
| 0.831 | 0.345 | 14.000 |

TABLE 1-continued

| X | Y | Z |
|---|---|---|
| 0.907 | 0.389 | 14.000 |
| 0.982 | 0.435 | 14.000 |
| 1.057 | 0.481 | 14.000 |
| 1.131 | 0.528 | 14.000 |
| 1.205 | 0.575 | 14.000 |
| 1.278 | 0.623 | 14.000 |
| 1.352 | 0.672 | 14.000 |
| 1.425 | 0.721 | 14.000 |
| 1.497 | 0.770 | 14.000 |
| 1.570 | 0.820 | 14.000 |
| 1.642 | 0.870 | 14.000 |
| 1.714 | 0.921 | 14.000 |
| 1.786 | 0.971 | 14.000 |
| 1.857 | 1.022 | 14.000 |
| 1.929 | 1.073 | 14.000 |
| 2.000 | 1.125 | 14.000 |
| 2.072 | 1.175 | 14.000 |
| 2.126 | 1.124 | 14.000 |
| 2.069 | 1.059 | 14.000 |
| 2.004 | 1.001 | 14.000 |
| 1.938 | 0.943 | 14.000 |
| 1.871 | 0.885 | 14.000 |
| 1.804 | 0.829 | 14.000 |
| 1.737 | 0.772 | 14.000 |
| 1.670 | 0.716 | 14.000 |
| 1.602 | 0.660 | 14.000 |
| 1.534 | 0.604 | 14.000 |
| 1.466 | 0.549 | 14.000 |
| 1.397 | 0.494 | 14.000 |
| 1.329 | 0.439 | 14.000 |
| 1.260 | 0.385 | 14.000 |
| 1.191 | 0.330 | 14.000 |
| 1.121 | 0.277 | 14.000 |
| 1.051 | 0.223 | 14.000 |
| 0.981 | 0.170 | 14.000 |
| 0.911 | 0.118 | 14.000 |
| 0.840 | 0.065 | 14.000 |
| 0.769 | 0.014 | 14.000 |
| 0.698 | −0.038 | 14.000 |
| 0.626 | −0.088 | 14.000 |
| 0.554 | −0.139 | 14.000 |
| 0.481 | −0.188 | 14.000 |
| 0.408 | −0.236 | 14.000 |
| 0.334 | −0.283 | 14.000 |
| 0.258 | −0.328 | 14.000 |
| 0.182 | −0.372 | 14.000 |
| 0.105 | −0.413 | 14.000 |
| 0.026 | −0.451 | 14.000 |
| −0.055 | −0.487 | 14.000 |
| −0.136 | −0.519 | 14.000 |
| −0.219 | −0.549 | 14.000 |
| −0.303 | −0.574 | 14.000 |
| −0.388 | −0.596 | 14.000 |
| −0.474 | −0.613 | 14.000 |
| −0.561 | −0.626 | 14.000 |
| −0.649 | −0.635 | 14.000 |
| −0.736 | −0.639 | 14.000 |
| −0.824 | −0.638 | 14.000 |
| −0.912 | −0.632 | 14.000 |
| −0.999 | −0.620 | 14.000 |
| −1.085 | −0.603 | 14.000 |
| −1.170 | −0.580 | 14.000 |
| −1.253 | −0.551 | 14.000 |
| −1.333 | −0.516 | 14.000 |
| −1.411 | −0.474 | 14.000 |
| −1.485 | −0.427 | 14.000 |
| −1.555 | −0.374 | 14.000 |
| −1.621 | −0.316 | 14.000 |
| −1.682 | −0.254 | 14.000 |
| −1.675 | −0.176 | 14.000 |
| −1.497 | −0.400 | 16.000 |
| −1.414 | −0.410 | 16.000 |
| −1.331 | −0.424 | 16.000 |
| −1.247 | −0.435 | 16.000 |
| −1.163 | −0.442 | 16.000 |
| −1.079 | −0.444 | 16.000 |
| −0.995 | −0.442 | 16.000 |
| −0.911 | −0.436 | 16.000 |

TABLE 1-continued

| X | Y | Z |
|---|---|---|
| −0.828 | −0.425 | 16.000 |
| −0.745 | −0.411 | 16.000 |
| −0.663 | −0.393 | 16.000 |
| −0.581 | −0.371 | 16.000 |
| −0.501 | −0.347 | 16.000 |
| −0.422 | −0.320 | 16.000 |
| −0.343 | −0.290 | 16.000 |
| −0.265 | −0.257 | 16.000 |
| −0.189 | −0.222 | 16.000 |
| −0.113 | −0.185 | 16.000 |
| −0.039 | −0.147 | 16.000 |
| 0.035 | −0.106 | 16.000 |
| 0.108 | −0.064 | 16.000 |
| 0.180 | −0.020 | 16.000 |
| 0.251 | 0.024 | 16.000 |
| 0.321 | 0.071 | 16.000 |
| 0.391 | 0.118 | 16.000 |
| 0.460 | 0.166 | 16.000 |
| 0.528 | 0.216 | 16.000 |
| 0.595 | 0.266 | 16.000 |
| 0.662 | 0.317 | 16.000 |
| 0.729 | 0.369 | 16.000 |
| 0.794 | 0.421 | 16.000 |
| 0.860 | 0.474 | 16.000 |
| 0.925 | 0.527 | 16.000 |
| 0.990 | 0.581 | 16.000 |
| 1.054 | 0.635 | 16.000 |
| 1.118 | 0.689 | 16.000 |
| 1.183 | 0.744 | 16.000 |
| 1.247 | 0.798 | 16.000 |
| 1.311 | 0.852 | 16.000 |
| 1.375 | 0.907 | 16.000 |
| 1.439 | 0.961 | 16.000 |
| 1.504 | 1.015 | 16.000 |
| 1.569 | 1.069 | 16.000 |
| 1.634 | 1.122 | 16.000 |
| 1.699 | 1.175 | 16.000 |
| 1.764 | 1.228 | 16.000 |
| 1.830 | 1.280 | 16.000 |
| 1.904 | 1.291 | 16.000 |
| 1.894 | 1.218 | 16.000 |
| 1.834 | 1.159 | 16.000 |
| 1.774 | 1.099 | 16.000 |
| 1.714 | 1.041 | 16.000 |
| 1.654 | 0.982 | 16.000 |
| 1.593 | 0.924 | 16.000 |
| 1.532 | 0.866 | 16.000 |
| 1.471 | 0.808 | 16.000 |
| 1.410 | 0.751 | 16.000 |
| 1.348 | 0.693 | 16.000 |
| 1.287 | 0.636 | 16.000 |
| 1.225 | 0.579 | 16.000 |
| 1.163 | 0.522 | 16.000 |
| 1.101 | 0.465 | 16.000 |
| 1.039 | 0.408 | 16.000 |
| 0.976 | 0.352 | 16.000 |
| 0.914 | 0.296 | 16.000 |
| 0.851 | 0.240 | 16.000 |
| 0.788 | 0.184 | 16.000 |
| 0.724 | 0.129 | 16.000 |
| 0.660 | 0.074 | 16.000 |
| 0.596 | 0.020 | 16.000 |
| 0.532 | −0.034 | 16.000 |
| 0.467 | −0.088 | 16.000 |
| 0.402 | −0.141 | 16.000 |
| 0.336 | −0.194 | 16.000 |
| 0.270 | −0.246 | 16.000 |
| 0.204 | −0.297 | 16.000 |
| 0.136 | −0.347 | 16.000 |
| 0.068 | −0.397 | 16.000 |
| −0.001 | −0.444 | 16.000 |
| −0.072 | −0.489 | 16.000 |
| −0.145 | −0.531 | 16.000 |
| −0.219 | −0.571 | 16.000 |
| −0.295 | −0.607 | 16.000 |
| −0.373 | −0.640 | 16.000 |
| −0.452 | −0.669 | 16.000 |
| −0.532 | −0.694 | 16.000 |

TABLE 1-continued

| X | Y | Z |
|---|---|---|
| −0.613 | −0.715 | 16.000 |
| −0.696 | −0.731 | 16.000 |
| −0.779 | −0.742 | 16.000 |
| −0.863 | −0.748 | 16.000 |
| −0.947 | −0.748 | 16.000 |
| −1.031 | −0.742 | 16.000 |
| −1.114 | −0.728 | 16.000 |
| −1.196 | −0.708 | 16.000 |
| −1.275 | −0.680 | 16.000 |
| −1.351 | −0.644 | 16.000 |
| −1.423 | −0.601 | 16.000 |
| −1.491 | −0.552 | 16.000 |
| −1.555 | −0.497 | 16.000 |
| −1.573 | −0.424 | 16.000 |
| −1.418 | −0.665 | 18.000 |
| −1.336 | −0.669 | 18.000 |
| −1.254 | −0.672 | 18.000 |
| −1.172 | −0.672 | 18.000 |
| −1.091 | −0.666 | 18.000 |
| −1.009 | −0.655 | 18.000 |
| −0.929 | −0.640 | 18.000 |
| −0.849 | −0.620 | 18.000 |
| −0.771 | −0.596 | 18.000 |
| −0.693 | −0.569 | 18.000 |
| −0.617 | −0.538 | 18.000 |
| −0.543 | −0.504 | 18.000 |
| −0.469 | −0.468 | 18.000 |
| −0.397 | −0.429 | 18.000 |
| −0.326 | −0.388 | 18.000 |
| −0.256 | −0.344 | 18.000 |
| −0.188 | −0.299 | 18.000 |
| −0.120 | −0.253 | 18.000 |
| −0.054 | −0.204 | 18.000 |
| 0.011 | −0.155 | 18.000 |
| 0.076 | −0.104 | 18.000 |
| 0.139 | −0.052 | 18.000 |
| 0.201 | 0.001 | 18.000 |
| 0.263 | 0.055 | 18.000 |
| 0.324 | 0.110 | 18.000 |
| 0.384 | 0.166 | 18.000 |
| 0.444 | 0.222 | 18.000 |
| 0.503 | 0.279 | 18.000 |
| 0.562 | 0.336 | 18.000 |
| 0.620 | 0.394 | 18.000 |
| 0.677 | 0.452 | 18.000 |
| 0.735 | 0.511 | 18.000 |
| 0.792 | 0.570 | 18.000 |
| 0.849 | 0.629 | 18.000 |
| 0.906 | 0.688 | 18.000 |
| 0.963 | 0.747 | 18.000 |
| 1.020 | 0.805 | 18.000 |
| 1.078 | 0.864 | 18.000 |
| 1.135 | 0.922 | 18.000 |
| 1.193 | 0.980 | 18.000 |
| 1.251 | 1.038 | 18.000 |
| 1.310 | 1.095 | 18.000 |
| 1.370 | 1.151 | 18.000 |
| 1.430 | 1.207 | 18.000 |
| 1.491 | 1.262 | 18.000 |
| 1.553 | 1.316 | 18.000 |
| 1.615 | 1.370 | 18.000 |
| 1.684 | 1.410 | 18.000 |
| 1.714 | 1.348 | 18.000 |
| 1.660 | 1.286 | 18.000 |
| 1.605 | 1.225 | 18.000 |
| 1.550 | 1.164 | 18.000 |
| 1.494 | 1.104 | 18.000 |
| 1.439 | 1.043 | 18.000 |
| 1.383 | 0.983 | 18.000 |
| 1.327 | 0.923 | 18.000 |
| 1.271 | 0.863 | 18.000 |
| 1.215 | 0.803 | 18.000 |
| 1.159 | 0.743 | 18.000 |
| 1.103 | 0.684 | 18.000 |
| 1.047 | 0.624 | 18.000 |
| 0.990 | 0.565 | 18.000 |
| 0.934 | 0.505 | 18.000 |
| 0.877 | 0.446 | 18.000 |

TABLE 1-continued

| X | Y | Z |
|---|---|---|
| 0.820 | 0.387 | 18.000 |
| 0.764 | 0.327 | 18.000 |
| 0.707 | 0.269 | 18.000 |
| 0.649 | 0.210 | 18.000 |
| 0.592 | 0.151 | 18.000 |
| 0.534 | 0.093 | 18.000 |
| 0.477 | 0.035 | 18.000 |
| 0.418 | −0.023 | 18.000 |
| 0.360 | −0.081 | 18.000 |
| 0.301 | −0.138 | 18.000 |
| 0.242 | −0.195 | 18.000 |
| 0.183 | −0.252 | 18.000 |
| 0.123 | −0.308 | 18.000 |
| 0.063 | −0.364 | 18.000 |
| 0.002 | −0.419 | 18.000 |
| −0.059 | −0.473 | 18.000 |
| −0.122 | −0.526 | 18.000 |
| −0.186 | −0.577 | 18.000 |
| −0.252 | −0.626 | 18.000 |
| −0.319 | −0.673 | 18.000 |
| −0.388 | −0.717 | 18.000 |
| −0.459 | −0.758 | 18.000 |
| −0.532 | −0.795 | 18.000 |
| −0.608 | −0.828 | 18.000 |
| −0.684 | −0.856 | 18.000 |
| −0.763 | −0.880 | 18.000 |
| −0.843 | −0.897 | 18.000 |
| −0.924 | −0.909 | 18.000 |
| −1.006 | −0.914 | 18.000 |
| −1.088 | −0.911 | 18.000 |
| −1.169 | −0.900 | 18.000 |
| −1.249 | −0.880 | 18.000 |
| −1.325 | −0.849 | 18.000 |
| −1.397 | −0.810 | 18.000 |
| −1.466 | −0.765 | 18.000 |
| −1.489 | −0.695 | 18.000 |
| −1.338 | −0.928 | 20.000 |
| −1.257 | −0.916 | 20.000 |
| −1.176 | −0.903 | 20.000 |
| −1.097 | −0.884 | 20.000 |
| −1.018 | −0.861 | 20.000 |
| −0.942 | −0.833 | 20.000 |
| −0.867 | −0.801 | 20.000 |
| −0.793 | −0.765 | 20.000 |
| −0.721 | −0.726 | 20.000 |
| −0.651 | −0.684 | 20.000 |
| −0.582 | −0.640 | 20.000 |
| −0.515 | −0.594 | 20.000 |
| −0.449 | −0.546 | 20.000 |
| −0.384 | −0.496 | 20.000 |
| −0.321 | −0.444 | 20.000 |
| −0.259 | −0.392 | 20.000 |
| −0.197 | −0.338 | 20.000 |
| −0.137 | −0.282 | 20.000 |
| −0.078 | −0.226 | 20.000 |
| −0.019 | −0.169 | 20.000 |
| 0.039 | −0.112 | 20.000 |
| 0.096 | −0.053 | 20.000 |
| 0.152 | 0.006 | 20.000 |
| 0.208 | 0.066 | 20.000 |
| 0.263 | 0.126 | 20.000 |
| 0.318 | 0.186 | 20.000 |
| 0.372 | 0.248 | 20.000 |
| 0.426 | 0.309 | 20.000 |
| 0.480 | 0.371 | 20.000 |
| 0.533 | 0.433 | 20.000 |
| 0.586 | 0.495 | 20.000 |
| 0.639 | 0.557 | 20.000 |
| 0.691 | 0.619 | 20.000 |
| 0.744 | 0.682 | 20.000 |
| 0.797 | 0.744 | 20.000 |
| 0.849 | 0.807 | 20.000 |
| 0.902 | 0.869 | 20.000 |
| 0.955 | 0.932 | 20.000 |
| 1.008 | 0.994 | 20.000 |
| 1.061 | 1.056 | 20.000 |
| 1.115 | 1.117 | 20.000 |
| 1.169 | 1.178 | 20.000 |

TABLE 1-continued

| X | Y | Z |
|---|---|---|
| 1.225 | 1.238 | 20.000 |
| 1.280 | 1.298 | 20.000 |
| 1.336 | 1.357 | 20.000 |
| 1.393 | 1.416 | 20.000 |
| 1.451 | 1.474 | 20.000 |
| 1.512 | 1.528 | 20.000 |
| 1.571 | 1.492 | 20.000 |
| 1.528 | 1.424 | 20.000 |
| 1.478 | 1.360 | 20.000 |
| 1.427 | 1.296 | 20.000 |
| 1.376 | 1.232 | 20.000 |
| 1.325 | 1.168 | 20.000 |
| 1.274 | 1.105 | 20.000 |
| 1.223 | 1.041 | 20.000 |
| 1.171 | 0.977 | 20.000 |
| 1.120 | 0.914 | 20.000 |
| 1.068 | 0.851 | 20.000 |
| 1.017 | 0.787 | 20.000 |
| 0.965 | 0.724 | 20.000 |
| 0.913 | 0.661 | 20.000 |
| 0.861 | 0.598 | 20.000 |
| 0.809 | 0.535 | 20.000 |
| 0.757 | 0.472 | 20.000 |
| 0.705 | 0.409 | 20.000 |
| 0.653 | 0.346 | 20.000 |
| 0.600 | 0.283 | 20.000 |
| 0.548 | 0.221 | 20.000 |
| 0.495 | 0.158 | 20.000 |
| 0.442 | 0.096 | 20.000 |
| 0.389 | 0.034 | 20.000 |
| 0.336 | −0.028 | 20.000 |
| 0.282 | −0.090 | 20.000 |
| 0.229 | −0.151 | 20.000 |
| 0.175 | −0.213 | 20.000 |
| 0.120 | −0.274 | 20.000 |
| 0.065 | −0.334 | 20.000 |
| 0.010 | −0.395 | 20.000 |
| −0.045 | −0.455 | 20.000 |
| −0.101 | −0.515 | 20.000 |
| −0.157 | −0.574 | 20.000 |
| −0.213 | −0.633 | 20.000 |
| −0.272 | −0.690 | 20.000 |
| −0.331 | −0.746 | 20.000 |
| −0.393 | −0.800 | 20.000 |
| −0.456 | −0.851 | 20.000 |
| −0.522 | −0.899 | 20.000 |
| −0.590 | −0.944 | 20.000 |
| −0.661 | −0.985 | 20.000 |
| −0.735 | −1.020 | 20.000 |
| −0.889 | −1.075 | 20.000 |
| −0.969 | −1.092 | 20.000 |
| −1.050 | −1.100 | 20.000 |
| −1.131 | −1.100 | 20.000 |
| −1.212 | −1.088 | 20.000 |
| −1.291 | −1.065 | 20.000 |
| −1.367 | −1.035 | 20.000 |
| −1.402 | −0.970 | 20.000 |

The present invention has been described in relation to particular embodiments, which are intended in all respects to be illustrative rather than restrictive. Alternative embodiments will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and sub-combinations are of utility and may be employed without reference to other features and sub-combinations. This is contemplated by and within the scope of the claims.

What is claimed is:

1. A turbine blade having an attachment, a neck extending radially outward from the attachment, a platform extending radially outward from the neck, an airfoil extending radially outward from the platform, and a shroud extending radially outward from the airfoil, where the airfoil has an uncoated profile substantially in accordance with Cartesian coordinate values of X, Y, and Z as set forth in Table 1, carried to three decimal places, wherein Z is a distance measured radially from the platform.

2. The turbine blade of claim 1, wherein the airfoil has manufacturing tolerances of about ±0.030 inches.

3. The turbine blade of claim 1, wherein a recessed region extends along a portion of an axial length of the platform.

4. The turbine blade of claim 3 further comprising a seal positioned within the recessed region.

5. The turbine blade of claim 1, wherein the blade is fabricated from a nickel-based alloy.

6. The turbine blade of claim 1 further comprising a MCrAlY bond coating applied to the airfoil.

7. The turbine blade of claim 6, wherein the coating is applied up to approximately 0.0055" thick to the airfoil.

8. An airfoil for a turbine blade having an uncoated profile substantially in accordance with Cartesian coordinate values of X, Y, and Z as set forth in Table 1, carried to three decimal places, wherein Z is a distance measured radially from a platform.

9. The airfoil of claim 8, wherein the airfoil has manufacturing tolerances of about ±0.030 inches.

10. The airfoil of claim 9 further comprising a coating up to 0.0055 inches thick.

11. The airfoil of claim 10, wherein the coating is a MCrAlY bond coating.

12. A plurality of turbine blades secured to a rotor disk to form a rotor stage, the turbine blades each having an airfoil having an uncoated profile substantially in accordance with Cartesian Coordinates values of X, Y, and Z as set forth in Table 1, wherein the profiles have a reduced swirl exiting from the rotor stage.

13. The plurality of turbine blades of claim 12, wherein adjacent turbine blades form a throat area of approximately 3,625 square inches.

14. The plurality of turbine blades of claim 12 further comprising a plurality of seals positioned between adjacent turbine blades.

15. The plurality of turbine blades of claim 14, wherein the seals are placed in a plurality of recessed regions that extend along a majority of a length of a platform of each turbine blade.

16. The plurality of turbine blades of claim 12, wherein the airfoil has manufacturing tolerances of about ±0.030 inches.

17. The plurality of turbine blades of claim 12 further comprising a MCrAlY bond coating applied to the airfoil.

18. The plurality of turbine blades of claim 17, wherein the bond coating is approximately 0.0055 inches thick.

* * * * *